US006481121B1

(12) United States Patent
Tucker

(10) Patent No.: US 6,481,121 B1
(45) Date of Patent: Nov. 19, 2002

(54) FOOTWEAR AND ACCESSORY DEVICE

(75) Inventor: Scott L. Tucker, Seattle, WA (US)

(73) Assignee: Montrail, Inc., Seattle, WA (US)

( * ) Notice: Subject to any disclaimer, the term of this patent is extended or adjusted under 35 U.S.C. 154(b) by 0 days.

(21) Appl. No.: 09/687,472

(22) Filed: Oct. 13, 2000

(51) Int. Cl.[7] ..... A43C 15/00; A43B 3/18

(52) U.S. Cl. ..... 36/62; 36/15; 36/7.7; 36/7.6; 36/59 R

(58) Field of Search ..... 36/15, 7.6, 7.7, 36/62, 64, 66, 59 R, 132, 117.3

(56) References Cited

U.S. PATENT DOCUMENTS 472,214 A * 4/1892 Hall
980,173 A * 12/1910 Clark
1,640,301 A * 8/1927 Torchia
RE18,054 E * 4/1931 Rubin
1,961,555 A * 6/1934 Driscoll
1,964,442 A * 6/1934 Roche
2,545,910 A * 3/1951 Aprile
2,776,499 A * 1/1957 Guintini
2,873,540 A * 2/1959 Murphy
2,888,754 A * 6/1959 Miller
3,538,628 A * 11/1970 Einstein, Jr.
3,685,173 A * 8/1972 Piazza ..... 36/7.6
4,108,452 A * 8/1978 Baron ..... 280/11.3
4,186,500 A * 2/1980 Salzman ..... 36/117.2
4,258,483 A * 3/1981 Hogue
4,377,042 A * 3/1983 Bauer
4,571,858 A * 2/1986 Faulin ..... 36/117.3
4,924,608 A * 5/1990 Mogonye ..... 15/227
4,936,028 A * 6/1990 Posacki ..... 36/15
5,410,821 A * 5/1995 Hilgendorf
5,533,280 A * 7/1996 Halliday ..... 36/15

* cited by examiner

*Primary Examiner*—M. D. Patterson
(74) *Attorney, Agent, or Firm*—Ann W. Speckman; Janet Sleath; Lisa Benado

(57) ABSTRACT

Improved footwear and accessory devices, such as crampons, are disclosed for enhancing the performance of footwear under different conditions and, thus, providing more versatile footwear. The footwear has an outsole flex zone in a forefoot region that flexes during hiking and climbing in various terrains. The footwear also includes toe and heel attachment points for installation of an accessory, such as a crampon and, additionally, includes a midfoot attachment point for mounting of the accessory. The midfoot attachment point is preferably located between the outsole flex zone and the heel attachment point. A forefoot contact mechanism may also be provided in the footwear outsole that interacts with a rigid forefoot contact mechanism of the accessory to enhance the rigidity of the forefoot region when the accessory is mounted. A crampon accessory device for mounting on the footwear is also disclosed.

12 Claims, 8 Drawing Sheets

FOOTWEAR AND ACCESSORY DEVICE

FIELD OF THE INVENTION

The present invention relates to footwear and associated accessories used in snow and ice. In particular, this invention relates to an integrated footwear design and a hardware accessory design that improves the ability to walk on level ground and to climb on steep snow and ice. The invention may be applied to all styles of mountaineering footwear.

BACKGROUND OF THE INVENTION

Mountaineering boots used to climb tall mountains where one encounters extreme cold temperatures, rock, snow and ice, have always had to compromise between hikeability and climbability. A boot that is ideal for hiking on level or slightly sloped ground where the surface is hard, such as a dirt trail, flexes comfortably at the ball of the foot in consort with the natural hinging of the foot. Such flexing at the metatarsal heads allows the foot to operate in a biomechanically advantageous position throughout the stride because the phalanges can maintain full contact during push-off and the flexor muscles can apply maximum leverage. This is what occurs during normal walking.

A boot that is ideal for climbing has a very rigid sole that does not flex appreciably at the ball of the foot. Rigid soles are important during climbing because they allow the use of rigid crampons with the boots, and because they allow the foot to remain in its most biomechanically advantageous position during climbing. Rigid crampons are generally mounted on the boots as an accessory and require a boot having a rigid sole so that the rigid crampon remains fixed to the boot via the attachment bails at the toe and the heel, and so that flexing of the boot does not put extreme force on the middle of the crampon, where it can be susceptible to breaking. A climber has a biomechanical advantage using a rigid boot having a crampon attached, because the point of contact of the crampon with the earth (ice, snow, or rock) is at the toe tip. A rigid boot allows the foot to apply the maximum force to the toe tip with the minimum muscles strain, thereby making the climber more efficient.

As a consequence of these conflicting performance criteria, high performance boots are suitable to only one type of activity, climbing or hiking. Since most mountains require a flat to moderately sloped approach on foot to the base of the steep and difficult route, climbers must carry two sets of footwear; one for the approach and one for the climb. This is a burdensome requirement in terms of weight and bulk, as well as an expensive one. Although some boots are designed with a medium flex so as to be marginally functional for both activities, professionals and highly skilled climbers cannot accept this compromise in footwear performance. The present invention eliminates the need for two sets of boots without compromising the performance in either hiking or climbing.

SUMMARY OF THE INVENTION

This invention is designed to allow footwear to flex comfortably to provide comfortable and efficient hiking performance, and then to be secured in a rigid position with the aid of a unique crampon design, to provide safe and efficient climbing performance. Thus, the same footwear may be used efficiently in the approach to a technical climbing region and, with the addition of an accessory, may be used efficiently and safely in technical climbing activities.

The design marries an underfoot frame that provides the proper flex characteristics of the boot as well as the crampon attachment devices, an outsole that is contoured to fit precisely with the crampon, and a unique crampon that attaches to the boot in such a way as to create a rigid system The invention solves the problem of needing to carry two sets of footwear to a mountain and also eliminates the need to compromise the performance of the boots for either hiking or climbing.

The invention comprises three parts: a component that lies under the foot but above the outsole, called the frame, that is integral with the footwear; an outsole that attaches to the bottom of the frame having specialized features for mating with a crampon accessory; and a crampon accessory that can be secured at multiple points to the frame and outsole. The frame and the outsole, which are integral with the footwear, provide the desired flex characteristics for hiking. These characteristics include the ability to flex comfortably across the ball of the foot at the metatarsal heads, and to provide rigidity through the arch and heel, as well as to inhibit twisting of the sole. When the crampon accessory is mounted to the boot using any suitable means, such as a traditional heel lever device, the footwear and crampon accessory system, in combination, becomes rigid and prevents flexing of the footwear at the ball of the foot, even when tremendous force is applied at the toe of the boot. The rigidity of the system stems from the rigidity of the crampon accessory and its attachment at three points of secure contact between the crampon and the boot. When the crampon accessory is positively attached at the toe, heel and at a central location under the foot, preferably at a location between the forefoot and the heel, the crampon's rigidity prevents the boot from flexing. The rigidity of the footwear and crampon accessory combination is desirably enhanced when the footwear outsole and the crampon accessory additionally interface and, preferably, interlock, at least at one site in proximity to the forefoot.

The frame is preferably constructed as a molded component that extends for the bottom length of the foot and is mounted in a fixed position intermediate the footwear insole and the outsole. The frame provides attachment points for the crampon accessory. In one embodiment, the frame component has a toe lip and a heel lip that extend upwardly from the plane of the footwear sole and provide toe and heel attachment means for mounting a crampon accessory. In another embodiment, the frame component comprises a central attachment means that extends downwardly from the plane of the footwear sole and provides a central attachment means intermediate the toe and heel for mounting a crampon accessory.

The frame component is made from materials and has dimensions that give it the desired flex properties. Specifically, the frame component is preferably made of composite materials or plastics that are strong, yet maintain their physical properties over a wide range of temperatures typically encountered in the high mountains and lowlands of Earth The design and composition of the frame component, and its integration with the footwear, allows the integrated footwear and frame to flex at the ball of the foot when a force, equal to that typically exerted by the human foot during walking, is applied to the forefoot. The frame component is also designed and constructed to inhibit flexing in the arch area or heel due to the dimensions and composition, even when tremendous force is applied to any point of the boot.

The frame component is also equipped with at least two attachment points that cooperate with attachment mechanisms on the crampon accessory to rigidly mount the footwear and crampon accessory to one another. In a preferred embodiment, at least three attachment points are provided on each of the footwear and crampon accessory: one at the toe; one at the heel; and one intermediate the toe and the heel, preferably intermediate the forefoot and the heel, and most preferably in the area under the arch The toe and heel attachment points may be of any conventional design, and may be, for example, of a design similar to those typically found on high performance mountaineering boots. An exemplary toe attachment point on footwear facilitates attachment of a wire bail from the crampon and allows the wire bail from the crampon to wrap around the toe of the boot and to rest securely on top of a flat platform An exemplary heel attachment point on footwear facilitates adjustable attachment of the crampon and cooperates with a plastic or metal heel lever that wraps around the heel of the boot and rests on top of a flat platform.

The third attachment point, intermediate the toe and heel attachment points, anchors the crampon to the sole at a point intermediate the toe and heel attachment points and, preferably, between the forefoot and heel portions, and eliminates movement, particularly flexing, between the boot and the crampon once the crampon is fixed in place. Without the midpoint attachment, a flexible boot may move away from the crampon when force is applied and therefore not perform optimally for climbing. Binding the crampon accessory to the boot at a midpoint as well as the two toe and heel end points, and ensuring that the flex point of the sole is in the forefoot area forward of the intermediate crampon accessory attachment point prevents the footwear from flexing when force is applied downward by a foot.

The outsole of the footwear boot is preferably designed to allow the midfoot crampon attachment in addition to providing for traction and wear protection on various surfaces. The outsole is designed with slots or holes in the area of the intermediate attachment point, preferably in the area under the arch, where the intermediate attachment piece(s) of the frame component protrude from the outer. The outsole is preferably designed to provide a substantial heel portion to provide traction in snow and dirt during ascents and descents.

Additionally, according to a preferred embodiment, a forefoot contact region is provided between the outsole and an accessory device, such as a crampon, to provide enhanced rigidity of the combination in the forefoot region when an accessory is mounted. In one embodiment, the outsole has contact elements that cooperate with stiffening elements formed on the crampon, and that allow the crampon to rest very closely to, or engage, the outsole in the area under the forefoot. This cooperation between rigid stiffening elements of the crampon with mating elements of the outsole in the forefoot area where the outsole has substantial flexibility provides a high degree of rigidity to the outsole when the crampon accessory is installed. The cooperation may be provided by way of one or more mating elements, such as grooves or slots, running lengthwise along the outsole, that cooperate with stiffening rails or tabs on the crampon accessory to mount the crampon accessory and the footwear in a stationary position relative to one another. The mating elements in the outsole, e.g., grooves, allow the crampon to be positioned more closely to the bottom of the boot, reducing the potential for the snow and ice to build underneath the crampon (known as "balling-up"), which reduces the effectiveness of the crampons. The mating elements in the outsole also allow the crampon to have a greater contact surface with the sole, thus substantially increasing the rigidity of the system.

The crampon accessory is designed to integrate with the frame component and the footwear outsole and to provide a rigid, integrated footwear/crampon device system. The crampon accessory may be equipped with a wire toe bail for attachment to the frame component (and, hence, the footwear) at the toe, a heel lever for attachment to the footwear at the heel, a midfoot attachment mechanism for attachment to the frame component (and, hence, the footwear) at a location intermediate the toe and the heel, and a rigid forefoot section located intermediate the toe bail and the midfoot attachment mechanism The midfoot attachment mechanism of the crampon accessory cooperates with the midfoot attachment point of the frame component. The crampon is also arrayed with "points" that are typical of crampon designs, and that provide traction in the ice and snow.

The crampon's ability to create a rigid system of the crampon/boot combination stems from the way in which the rigid forefoot portion of the crampon bridges the flex zone of the boot and is secured on either side of the flex zone. The frame is designed to flex, not hinge, across the ball of the foot. The frame will bend in an arc with a radius of about 20 mm. This arc represents the flex zone and the midpoint in the arc is referred to as the flex point. By fixing a rigid component (the crampon) to either side of the flex zone (i.e. attaching at the toe and the midpoint of the frame), and by making positive contact with the crampon along cooperating mating elements, such as grooves, in the outsole, the crampon prevents the frame and, hence, the outsole of the footwear, from flexing.

According to one embodiment, the crampon has a hinge in the middle that does not affect the rigidity of the forefoot piece, and allows the crampon to be attached easily to the boot. The hinge may be provided on either side of the midfoot attachment point of the crampon. Multiple hinges or pivots may be provided for ease of installation and removal of the crampon device, provided that the rigidity of the forefoot piece is preserved.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENTS

Figure 1:
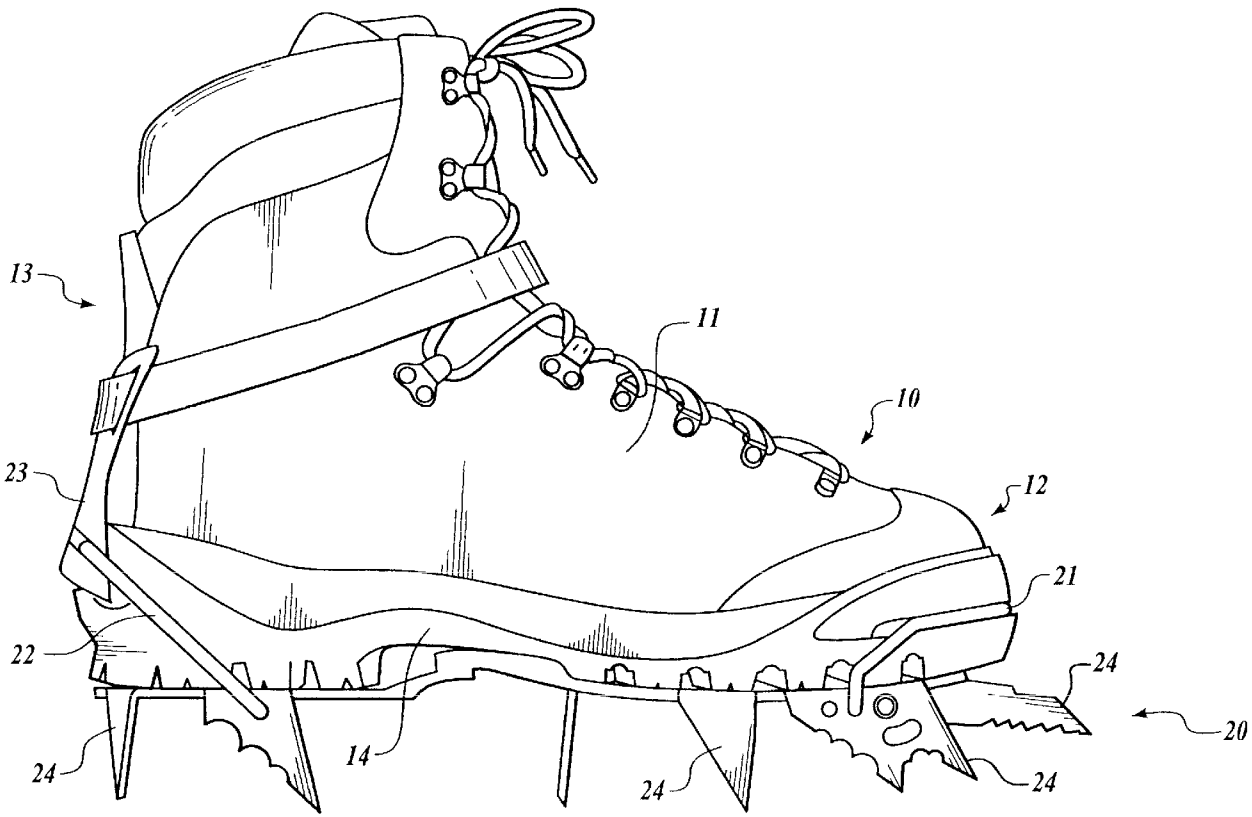
FIG. 1 shows a side perspective view of a mountaineering boot with an outsole and with a crampon accessory attached.

FIG. 1 shows a typical mountaineering boot 10 having a crampon 20 attached. The boot 10 comprises upper (11) constructed from natural and/or synthetic materials, such as synthetic fabrics or molded plastics, and having a toe portion 12 and heel portion 13. Upper 11 is designed to envelope the foot and hold it securely, both for control and for protection from the elements, rock and snow. Mountaineering boot 10 additionally comprises an outsole 14 constructed, for example, from rubber, that is molded to provide lugs for traction on a variety of surfaces found in the mountains.

A crampon 20 attaches rigidly to boot 10 by means, for example, of a toe bail 21 and a heel lever 23 fastened to a heel bail 22. Toe bail 21 and heel lever 23 mate with and are retained in indentations provided for that purpose in the toe and heel portions of outsole 14. In the embodiment illustrated in FIG. 1, crampon 20 is mounted to and released from boot 10 by means of heel lever 23 that, in an open position, permits mounting of the crampon on and removal of the crampon from the boot and, in a closed position, tightens the toe bail and the heel lever against the mating indentations in the outsole to rigidly fix the crampon in place on the boot. Additionally or alternatively, straps may be provided to maintain contact between a crampon and the outsole of the boot. Crampons may, for example, be fixed to the sole of the boot with no fastening means other than straps that wrap over the instep of the boot and around the ankle. Crampon 20 is equipped with an array of rigid points 24 for biting into and gripping snow and ice. Points 24 may project from the plane of crampon 20 at various angles and are generally made of hardened steel or another highly rigid material to grip in the snow and ice.

Figure 2:
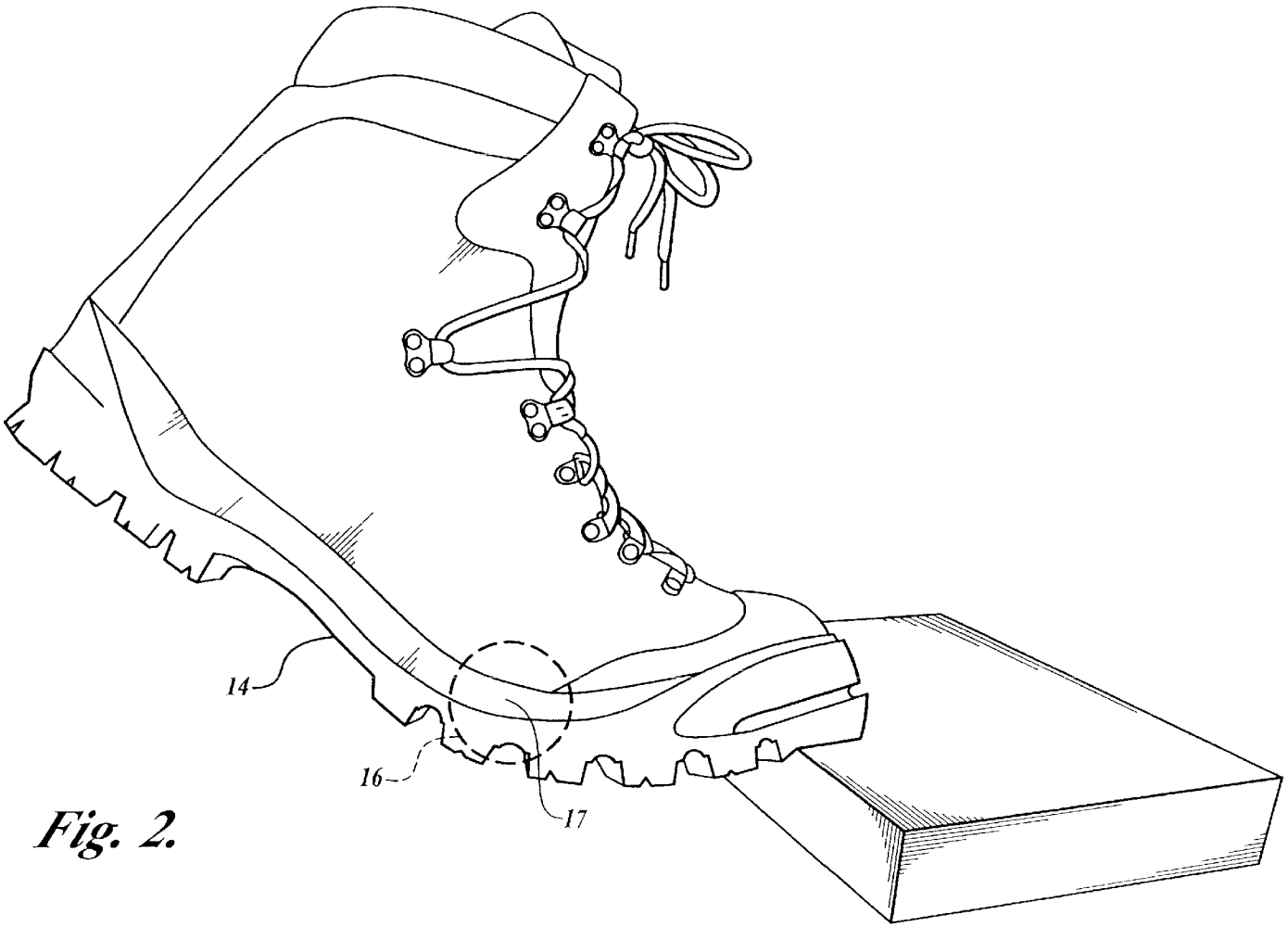
FIG. 2 shows a side perspective view of a hiking boot being flexed and illustrating the flex zone desired for ascending and descending in a hiking boot. Flexing in this zone is not desired for mountaineering when crampon accessories are used.

When a boot is being used for hiking on level ground, or ascending or descending under biking conditions, such as on a dirt or rock trail where no crampon is desired, the boot should flex in proximity to the ball of the foot in a flex zone located generally below the ball of the foot. This requires flexing of both the upper and the outsole. The flex zone of outsole 14 is illustrated in FIG. 2 as zone 16, which encompasses the flex point 17, which corresponds to the location of the joint in the foot at the metatarsal heads. FIG. 2 illustrates that flex zone 16 preferably forms an arc with a radius of about 20 mm.

The fundamental system components for both the improved footwear and the crampon accessory are illustrated in FIGS. 3–8. These components include a frame component 30, an outsole 40, and a crampon accessory 50. The frame component 30 and outsole 40 are mounted to and form the lower portion and lower outside surface of footwear, and the crampon accessory is mountable to and releasable from the frame component/outsole combination and, hence, the footwear. The three fundamental components are arranged in a stacked relationship when the crampon accessory is mounted, with the frame component nearest the foot and the crampon attached adjacent the exposed, outer surface of the outsole.

Figure 3:
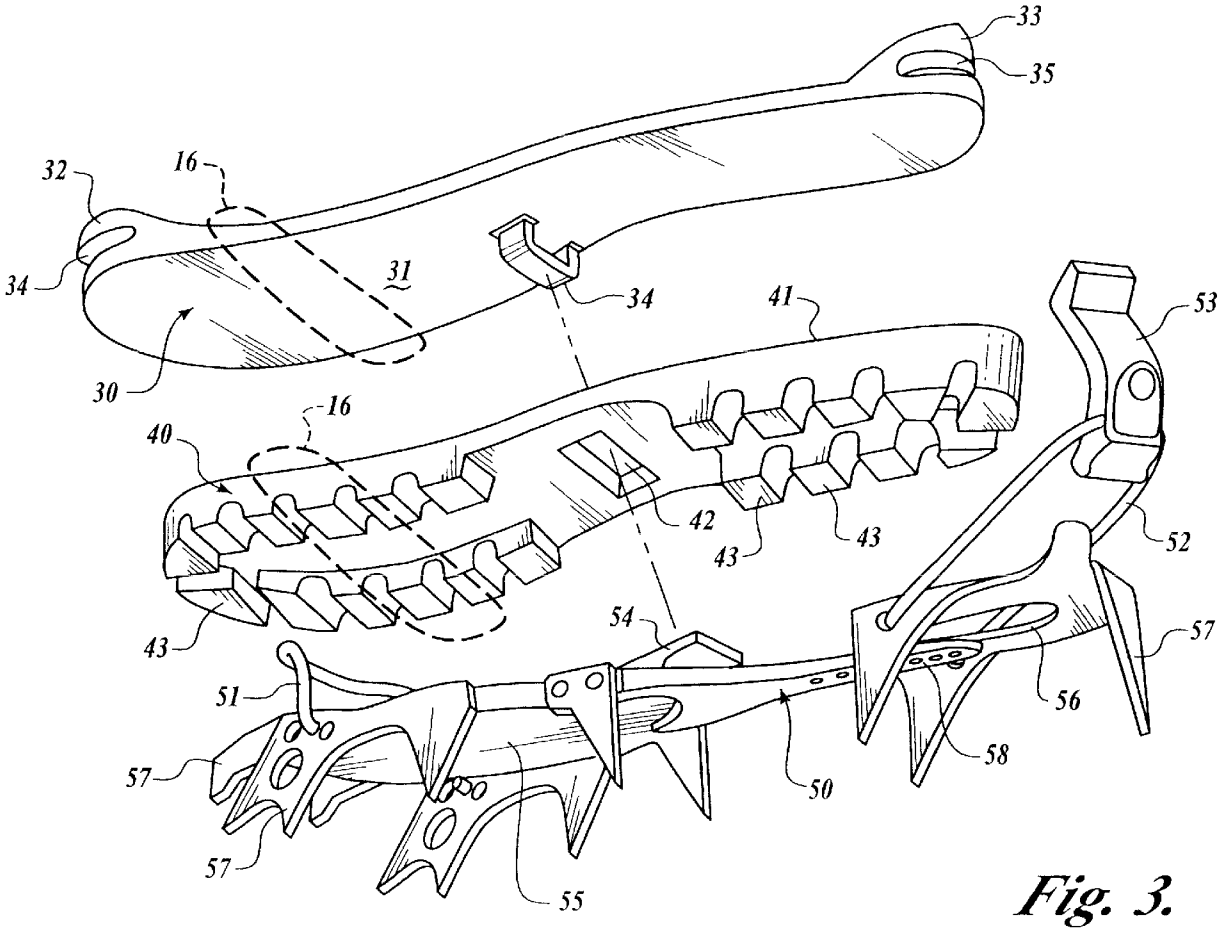
FIG. 3 shows an exploded perspective side view of the system components, the frame component, the footwear outsole, and the crampon accessory.

FIG. 3 shows one embodiment wherein frame component 30 is a unitary component comprising a generally footbed-shaped base element 31, an enlarged toe portion 32, an enlarged heel portion 33, and a midfoot accessory attachment element 34. Enlarged toe and heel portions 32 and 33, respectively, are provided with engagement mechanisms that mate with corresponding engagement mechanisms of an accessory item, such as a crampon accessory, to secure the accessory to the base element and, hence, the footwear. Frame component 30 preferably comprises a material that provides the desired flex in flex zone 16, yet it preferably does not flex or twist in other areas. Suitable materials include steel (perhaps of varying thicknesses), composite materials such as plastics having glass or carbon fibers or other reinforcing materials, epoxy resins, Dupont HYTREL and Dupont ZYTEL brand synthetic materials, and the like. Other suitable materials are well known in the art.

Frame component 30 may be constructed from composite materials, as described, and it may have a composite design that provides different flex properties in different areas of the component. For example, frame component 30 may comprise three pieces: a forefoot, a heel and an arch plate that nests into a space between the forefoot and heel components. The forefoot piece may be constructed of a material that provides a desired degree of flex in the forefoot flex zone; and the arch and heel plates may be constructed from materials having a higher rigidity. In this embodiment, the heel plate may be constructed from carbon fiber, the arch plate may be constructed from steel, and the forefoot piece may be constructed from nylon. Frame component 30 is illustrated in FIG. 3 as having the general configuration of a footbed and, while this is a preferred embodiment, the present invention is by no means limited to this design.

Outsole 40, if provided as a separate component from frame component 30, has an upper surface 41 that mates with and is fastened to the lower surface of frame component 31, an opening 42 for passage of midfoot accessory attachment mechanism 34, and a plurality of lugs 43 for gripping the terrain. Outsole 40 provides the exterior surface of the footwear that contacts the terrain when an accessory device is not installed, such as during hiking, and during ascents and descents that do not require the use of an accessory device such as a crampon. Outsole 40, like frame component 30, comprises a material that provides the desired flex in flex zone 16.

Figure 4:
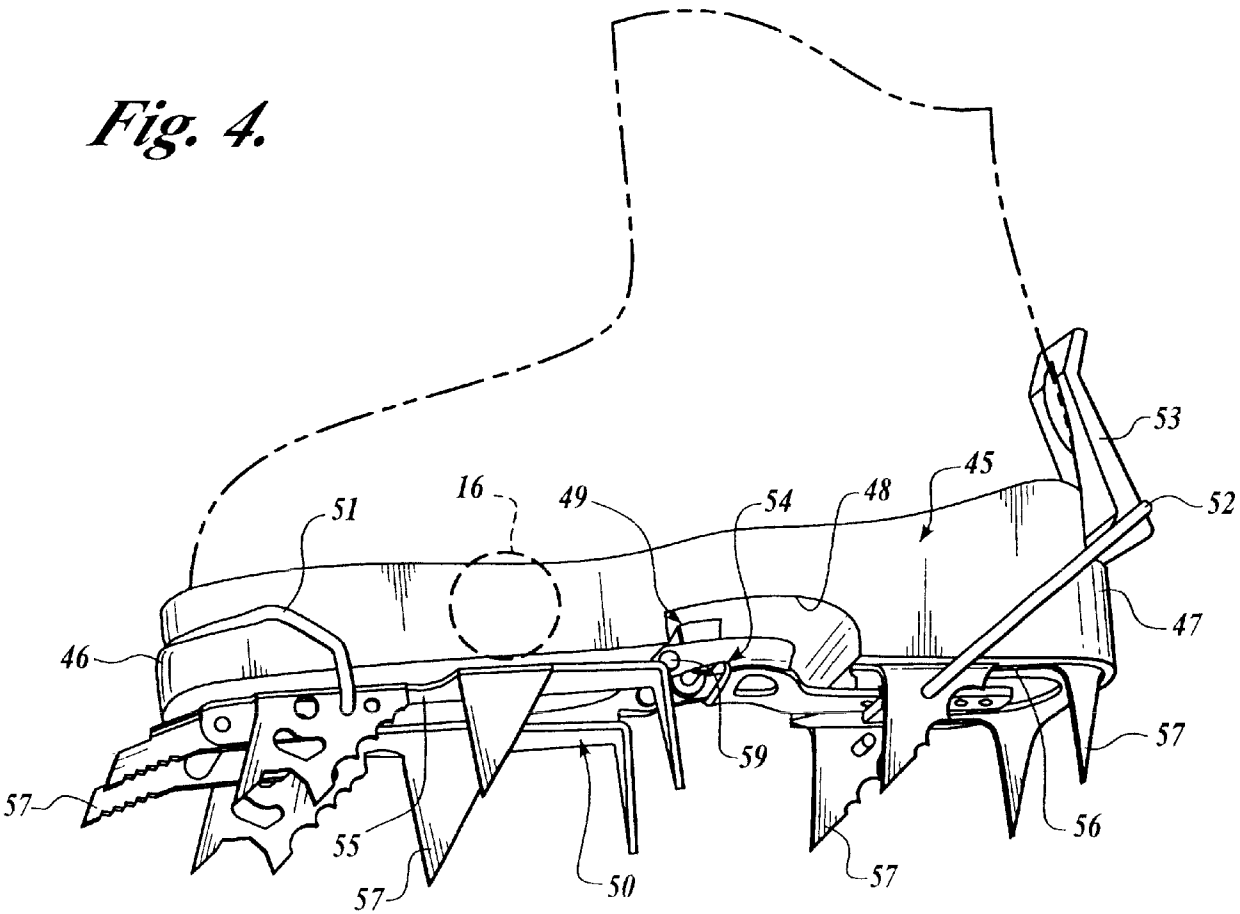
FIG. 4 shows a side perspective view of system components of the present invention assembled, highlighting the location of the attachment points relative to the flex zone of the boot.

In the embodiment illustrated in FIG. 3, frame component 30 and outsole 40 are provided as separate, unitary components that, in combination, form the base of footwear and provide the attachment points for attachment of footwear accessories, such as crampons. While these components are illustrated in FIG. 3 as unitary components, the frame component and outsole may alternatively be provided as a unitary component, as shown in FIG. 4. Whether provided as a combination of two components, or as a unitary, integrated component, the important aspects of the frame/outsole assembly are as follows: (1) it provides an attachment mechanism located at a toe portion and/or a heel portion and, preferably, at both toe and heel portions, for attachment of an accessory; (2) it provides a midfoot attachment mechanism located between the toe and heel portions for attachment of an accessory, the midfoot attachment mechanism preferably being located between the forefoot flex zone and the heel portion of the frame/outsole assembly; and (3) a forefoot flex zone provides flexing of the assembly in the forefoot region.

Engagement mechanisms on enlarged toe and heel portions 32 and 33 of frame component 30 may be provided as slots 34 and 35, as illustrated in FIG. 3, or other types of engagement mechanisms may be employed, as is well known in the art. Similarly, midfoot accessory attachment element 34 of frame component 30 may be provided as a U-shaped projection, as illustrated in FIG. 3, or as a shallow hooked element, or it may be provided as any alternative engagement mechanism that, in combination with a mating attachment element on an accessory, such as a crampon, secures an accessory to the base element and, hence, the footwear.

Figure 6:
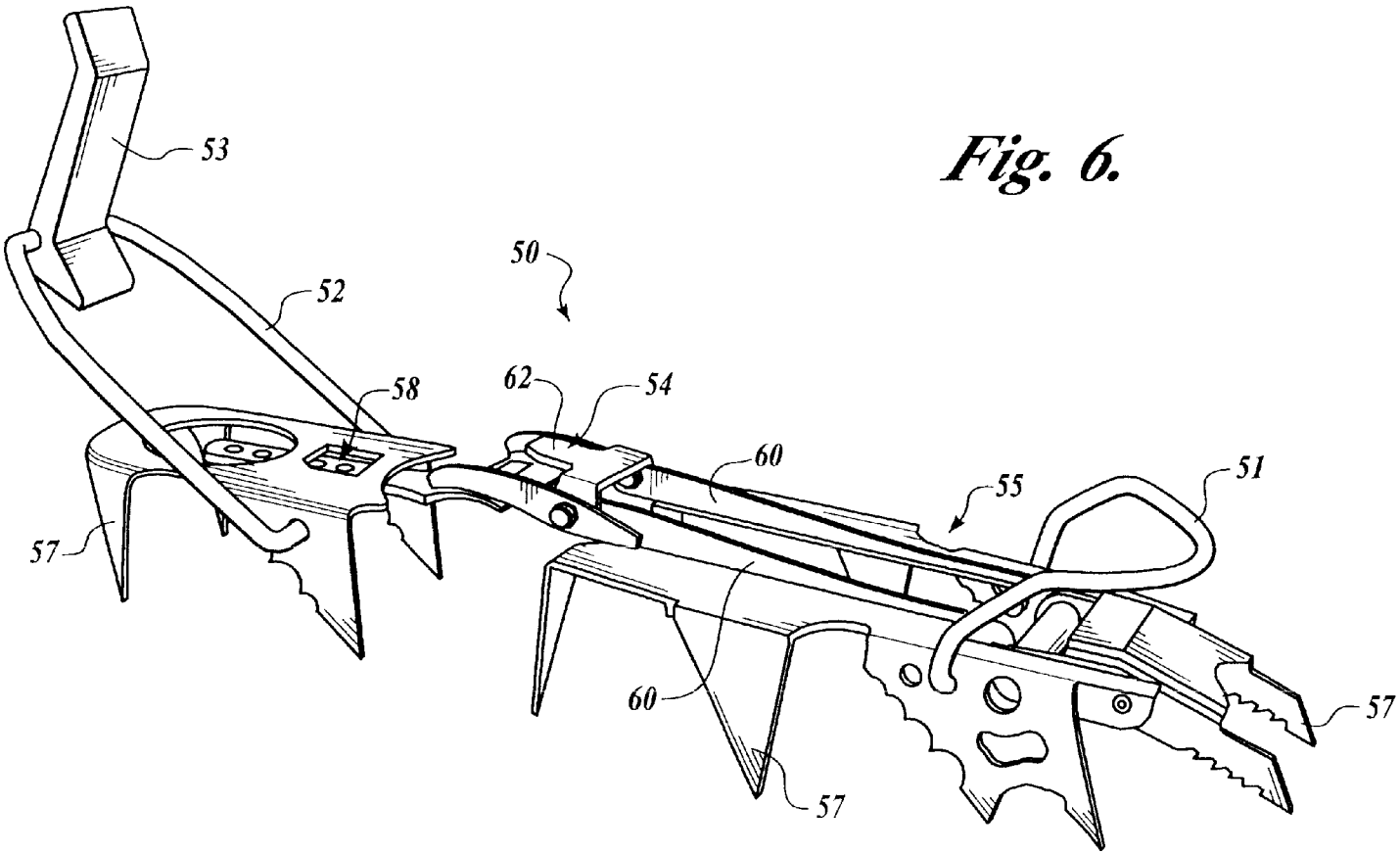
FIG. 6 shows a side perspective drawing of a crampon accessory of the present invention.

Crampon accessory 50, as illustrated in FIGS. 3 and 6, comprises a toe attachment mechanism in the form of toe bail 51, a heel attachment mechanism in the form of heel bail 52 and an installation/release mechanism in the form of lever 53, and a midfoot attachment mechanism 54 that cooperates with midfoot accessory attachment mechanism 34 to secure the crampon accessory to the frame component/outsole assembly and, hence to the footwear. The midfoot attachment mechanism 54 may be in the form of a tab that is slidable in a slot, as shown in FIG. 3, or alternative mating attachment mechanisms may be provided. The midfoot attachment mechanism may employ, for example, a spring-loaded clip that is retained in a mating retainer, a buckle type of fastener, a mechanism in which pins are received and retained in mating holes, spring-loaded and lever-operated mechanisms. Attachment mechanisms that are used in snowboard bindings are bicycle pedal bindings are generally suitable, though they may require some modification for use with the footwear and accessory of the present invention.

Midfoot attachment mechanism 54 is located intermediate the toe and heel attachment mechanisms and, preferably, is located intermediate the forefoot flex zone of footwear and the heel attachment mechanism of crampon accessory 50. Crampon accessory 50 additionally comprises a rigid forefoot portion 55 and a rigid heel portion 56, with both the forefoot and heel portions having a plurality of points 57 oriented at desired angles from the plane of the forefoot and heel portions. Crampon accessory 50 may also have a pivot device located in a midfoot section permitting the crampon to fold for convenient transport, storage and mounting, and it may be provided with a size adjustment mechanism 58 for lengthening or shortening the crampon to fit various sizes of footwear.

FIG. 4 illustrates a crampon accessory mounted to a unitary frame component/outsole assembly. In this embodiment, outsole assembly 45 incorporates flex zone 16, an enlarged toe shoulder 46 for engagement and attachment of toe bail 51 of crampon device 50, an enlarged heel shoulder 47 for engagement and attachment of heel bail 52 and lever 53 of crampon device 50, and a midfoot cutaway portion 48 and midfoot accessory attachment mechanism 49. Crampon accessory 50 comprises rigid forefoot portion 55, rigid heel portion 56, midfoot attachment mechanism 54, pivot 59, and a plurality of points 57. In this embodiment, a framework for rigid forefoot and heel portions 55 and 56, respectively, generally follows the peripheral contour of outsole assembly 45. The midfoot attachment point is preferably between the flex zone and the heel attachment point, as illustrated.

Figure 5:
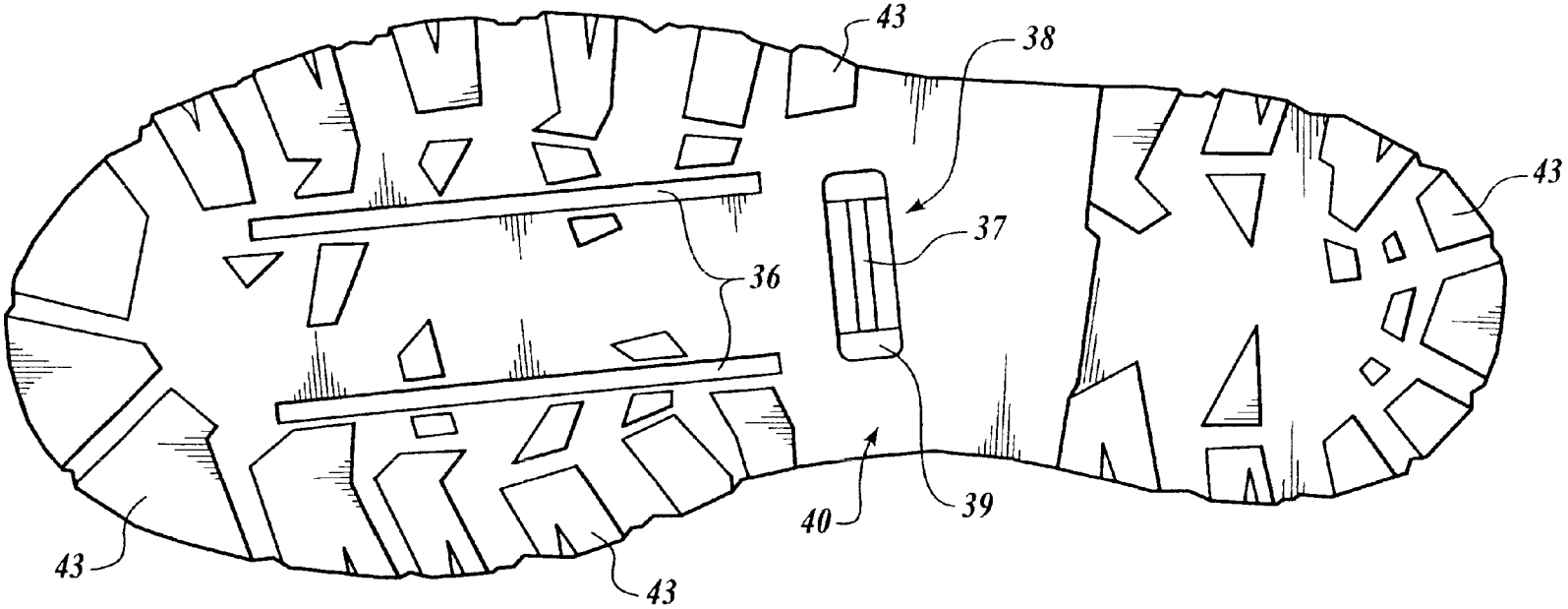
FIG. 5 shows a bottom perspective view of the outsole, illustrating the orientation and position of mating grooves for cooperating with the crampon accessory and the midfoot attachment mechanism.

FIG. 5 illustrates a preferred embodiment of outsole 40. The outsole is designed to perform optimally on various terrains. The outsole is generally constructed from a durable and flexible material, such as rubber, and is molded to provide lugs 43 of various shapes and sizes to effectively grip in dirt, rock, snow and ice. According to a preferred embodiment, the forefoot portion of outsole 40 is provided with a forefoot contact mechanism that contacts an accessory device, such as a crampon, to provide enhanced contact between the forefoot portion of outsole 40 and the accessory device. The forefoot contact mechanism is preferably provided in the area of the flex zone.

In the embodiment illustrated in FIG. 5, the forefoot contact mechanism provides engagement of the forefoot portion of outsole 40 with the accessory device. Two grooves 36 are provided running lengthwise from the toe portion of the outsole to a position forward of the midfoot attachment mechanism, spanning the flex zone. Rigid rails provided on an accessory device, such as a crampon, mate with and are retained in groves 36 when an accessory device is installed. Engagement of a rigid portion of an accessory device with the outsole in the region of the flex zone provides improved rigidity of the forefoot portion of the footwear during use of the accessory device, such as a crampon. Various contact and engagement means that are well known in the art may be employed.

According to a preferred embodiment, the forefoot contact mechanism provides contact between the outsole and the accessory device in the forefoot area over a distance of at least 50 mm. The length of the contact and/or engagement mechanism necessarily varies, depending upon the size of the boot, being shorter for small women's sizes and longer for large men's sizes. The contact surface between the crampon and the boot sole increases the rigidity of the system by reducing the ability of the boot to move relative to the crampon.

FIG. 5 also illustrates the midfoot attachment point the form of a bracket 38 that is designed to allow a tab from the crampon to slide underneath the bracket. Bracket 38 may be provided, for example, as a rigid bar 37 oriented transverse to the length of the boot and secured to the outsole by posts 39 at either end. The bar 37 is preferably separated from the surface of the outsole by at least about 3 mm, more preferably approximately 5 mm, to allow a mating tab of the crampon to be inserted under it. Midfoot attachment point 38, as shown in FIG. 5, is arranged generally transverse to the longitudinal orientation of outsole 40 and, according to a preferred embodiment, has a longitudinal axis that is approximately perpendicular to the longitudinal axis of outsole grooves 36 providing the forefoot contact mechanism.

The midfoot attachment point may take on various forms as long as it performs the function of securing a mating midfoot attachment mechanism the crampon, or another accessory device, to the sole of the boot. In one alternative embodiment, for example, two opposing L-shaped brackets or posts may be provided as the footwear midfoot attachment point, with the two opposed L-shaped brackets forming, in combination, a slot that retains a mating tab provided on the accessory device.

FIG. 6 illustrates preferred features of the crampon accessory design, many of which have been described previously. The rigid rails 60 that run the length of rigid forefoot portion 55 enhance the rigidity and stiffness for the crampon forefoot portion, and cooperate with a forefoot contact mechanism provided on the outsole to provide enhanced rigidity to the crampon and boot combination in the forefoot region when the crampon is mounted. According to a preferred embodiment, rigid rails 60 are retained in grooves 36 provided in the forefoot portion of the outsole. The forefoot crampon tab 62 is shown as an integral part of the crampon forefoot part. The heel lever 53 attaches the crampon to the heel of the boot and provides tension between the toe bail 51 and the midfoot attachment point. As long as there is tension in the system, the system will remain rigid.

Figure 7:
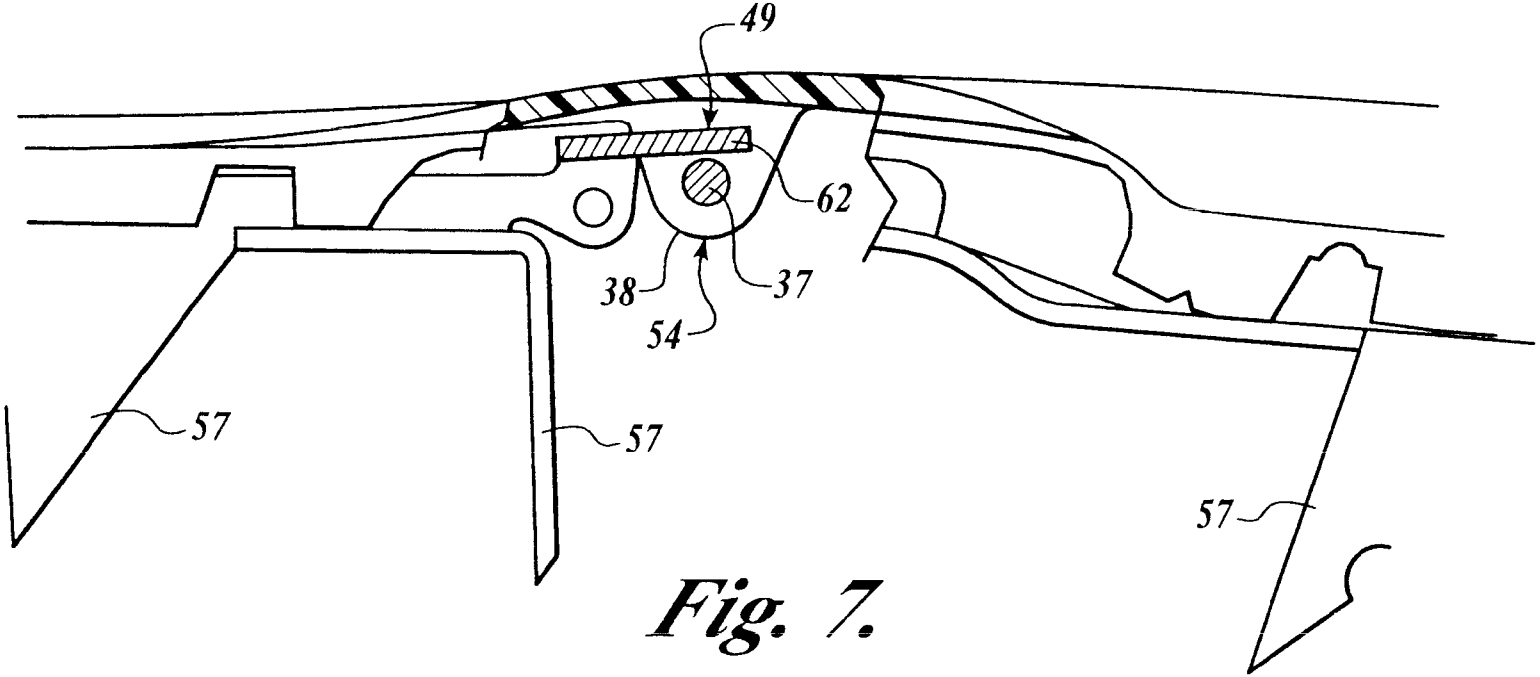
FIG. 7 shows a cutaway side perspective view of the midfoot attachment area of the frame component with the crampon tab inserted.

The midfoot attachment mechanism 54 engaged with an accessory attachment mechanism 49 of a frame and/or outsole can be clearly seen in the cutaway view FIG. 7. The forefoot crampon tab 62 rests securely underneath bracket 38 and contacts metal bar 37. When the boot attempts to flex under the stress of the foot putting pressure on the toe of the boot, the midfoot region of the boot will try to move in the direction of the arrow. However, since the crampon tab 62 is secured against bracket 38 at the midfoot attachment point, the boot is prevented from flexing.

Figure 8:
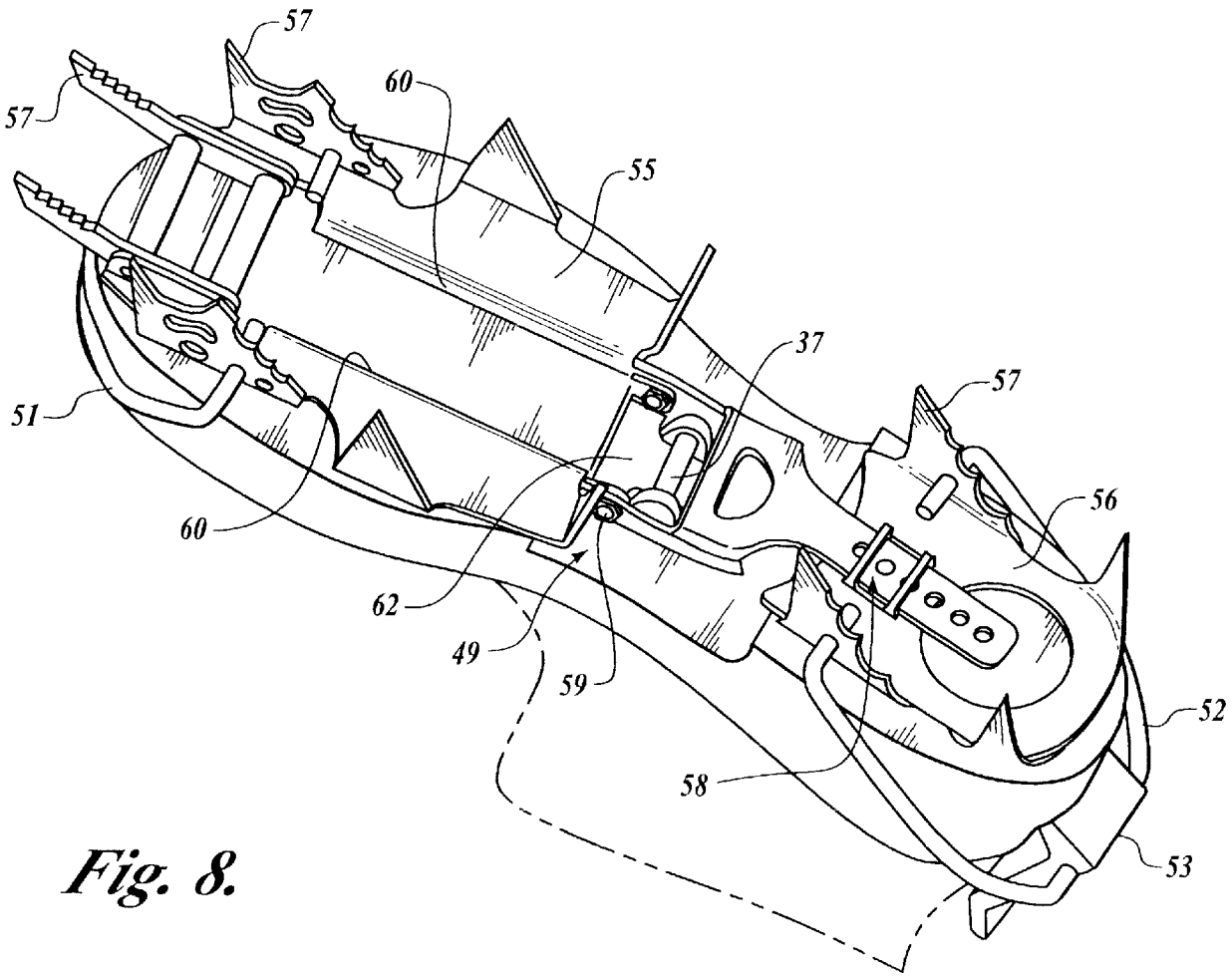
FIG. 8 shows a bottom perspective view of a crampon accessory mounted to footwear.

FIG. 8 shows the bottom view of the crampon and midfoot attachment mechanism 49. The tab on the forefoot portion of the crampon can be seen inserted under the crampon attachment bar 37. In this embodiment of the design, the crampon tab 62 slides under the crampon attachment bar 37 from the front. Other attachment mechanisms could be developed, however that do not require a tab to slide under a bar. The midfoot attachment mechanism will function as designed so long as the forefoot part of the crampon can be secured to the sole and the crampon can be easily fixed or removed from the boot. The crampon further includes a rigid heel portion 56, a rigid forefoot 55 having rails 50, a size adjustment mechanism 58, a toe bail 51, a heel bail 52, a lever 53, a pivot 59, and points 57, as described above with regards to FIGS. 3, 4, 6 and 7.

While the present invention has been described with reference to certain specific and preferred embodiments, it will be recognized that various modifications may be made to the embodiments described that provide the benefits of the present invention, as broadly described. These modifications are intended to be encompassed by the present invention.

I claim:

1. An article of footwear comprising:

an outsole, and a frame positioned above the outsole, the frame being flexible in a forefoot region of the footwear and having a toe attachment mechanism, a heel attachment mechanism and a midfoot attachment mechanism for attachment of an accessory device on a lower surface of the outsole at a toe portion, a heel portion and a midfoot location of the outsole intermediate between the forefoot region and the heel portion, the outsole having an exterior contacting surface including lugs for traction on terrain when an accessory device is not installed.

2. An article of footwear according to claim 1, wherein the midfoot attachment mechanism is provided as at least one bracket extending out of the plane of the frame and through the exterior contacting surface of the outsole.

3. An article of footwear according to claim 1, additionally comprising an accessory device mounted on the footwear and attached to the toe attachment mechanism, the heel attachment mechanism, and the midfoot attachment mechanism.

4. An article of footwear and accessory device combination according to claim 3, wherein the accessory device is a crampon device having a plurality of points.

5. An article of footwear and accessory device combination according to claim 3, wherein the outsole has at least one groove in a forefoot region and the accessory device has at least one rigid rail in a rigid forefoot portion that mates with and engages in the groove.

6. An article of footwear according to claim 1, wherein the outsole comprises at least one contact element positioned in a forefoot region of the outsole for contacting the accessory device and providing enhanced rigidity when the accessory device is installed.

7. An article of footwear according to claim 6, wherein the contact element comprises a groove extending generally in the direction of a longitudinal axis of the outsole.

8. An article of footwear according to claim 6, wherein, when the accessory device is installed, the contact element cooperates with at least one rigid stiffening element provided on the accessory device.

9. An article of footwear according to claim 6, additionally comprising an accessory device amounted on the footwear and attached to the toe attachment mechanism, the heel attachment mechanism, and the midfoot attachment mechanism, wherein positive contact is maintained between the forefoot region of the outsole and a rigid forefoot portion of the accessory device.

10. The article of footwear of claim 1, wherein the outsole has an opening to receive the midfoot attachment mechanism.

11. An article of footwear comprising an outsole and a frame positioned above the outsole, the outsole having an exterior contacting surface to contact terrain when an accessory device is not installed, the frame being flexible in a forefoot region of the footwear and having a toe attachment mechanism and a heel attachment mechanism for attachment of an accessory device on a lower surface of the outsole at a toe portion and a heel portion, and additionally having a midfoot attachment mechanism for attachment of an accessory device at a midfoot location intermediate between the forefoot region and the heel portion, wherein the outsole is provided with at least one groove positioned in a forefoot region of the outsole and extending generally in the direction of a longitudinal axis of the outsole for contacting a stiffening element on an accessory device and the outsole is provided with exterior contacting surface including lugs for traction on terrain when an accessory device is not installed.

12. An article of footwear according to claim 11, additionally comprising an accessory device mounted on die footwear and attached to the toe attachment mechanism, the heel attachment mechanism, and the midfoot attachment mechanism, wherein positive contact is maintained between the forefoot region of the outsole and a rigid forefoot portion of the accessory device.

* * * * *

UNITED STATES PATENT AND TRADEMARK OFFICE

CERTIFICATE OF CORRECTION

PATENT NO. : 6,481,121 B1
DATED : November 19, 2002
INVENTOR(S) : Scott L. Ticker It is certified that error appears in the above-identified patent and that said Letters Patent is hereby corrected as shown below:

Column 10,
Line 20, replace “amounted” with -- mounted --
Line 48, replace “die” with -- the --

Signed and Sealed this

Twenty-third Day of December, 2003

JAMES E. ROGAN
*Director of the United States Patent and Trademark Office*